US005551409A

United States Patent [19]

Sanders

[11] Patent Number: 5,551,409

[45] Date of Patent: Sep. 3, 1996

[54] OIL SEPARATOR FOR ENGINE VENT SYSTEM

[75] Inventor: Brian V. Sanders, Westland, Mich.

[73] Assignee: Chrysler Corporation, Highland Park, Mich.

[21] Appl. No.: 566,102

[22] Filed: Dec. 1, 1995

[51] Int. Cl.[6] ..... F02B 25/06

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 2,359,485 | 10/1944 | Lowther | 123/574 |
| 3,073,293 | 1/1963 | Barker . | |
| 3,524,437 | 8/1970 | Crandall | 123/573 |
| 3,587,542 | 6/1971 | Miles | 123/574 |
| 3,877,451 | 4/1975 | Lipscomb | 123/573 |
| 4,515,137 | 5/1985 | Manolis | 123/572 |
| 4,667,647 | 5/1987 | Ohtaka et al. | 123/573 |
| 4,886,019 | 12/1989 | Davis et al. | 123/41.86 |
| 5,205,848 | 4/1993 | Blanc et al. . | |
| 5,507,268 | 4/1996 | Schlattl | 123/572 |

*Primary Examiner*—Marguerite McMahon
*Attorney, Agent, or Firm*—Kenneth H. MacLean

[57] ABSTRACT

This invention relates to an oil separator for use in an engine ventilation system for allowing air flow alternately into and out of the engine crankcase without permitting the escape of significant quantities of oil with the air flow. A tube within a tube design forms a compact and effective configuration subjecting the flow to several directional changes and a decrease in velocity effective to cause oil to separate from the flow.

4 Claims, 1 Drawing Sheet

OIL SEPARATOR FOR ENGINE VENT SYSTEM

TECHNICAL FIELD

This invention relates to an oil separator apparatus for use in an engine ventilation system for allowing air flow alternately into and out of the engine crankcase without permitting the escape of significant quantities of oil with the air flow.

BACKGROUND OF THE INVENTION

Engine designers have long been concerned about the separation of oil from an air flow in an engine ventilation system. Under certain operating conditions of the engine such as wide open throttle operation and/or operation under a relatively heavy load, for example, an outward flow of air passes from and engine crankcase, through the ventilation system, and into the air/fuel induction system. Other times, the air flow is in an opposite inward direction from the air/fuel induction system, through the ventilation system, and into the engine interior or crankcase.

Previously, engines have attempted to prevent the escape of significant quantities of oil with the above described outward air flow. Current engines utilize a baffle or multiple baffles within the valve cover of an engine and adjacent the air flow opening of the engine ventilation system. Disadvantages of such an arrangement are: the complexity and resultant cost; and the need to take-up valuable space within the valve cover which can result in increased engine size.

A pre-examination patent search of the subject oil separator uncovered the following U.S. Pat. Nos.: 5,205,848 to Blanc; 4,886,019 to Davis; 4,667,647 to Ohtaka; 4,515,137 to Manolis; 3,073,293 to Barker. The device disclosed in the Ohtaka patent is representative of the prior art separator using baffles formed in a valve cover. The device disclosed in the Davis patent provides a check valve to prohibit flow in both directions and does not provide an air/oil separator structure. The device disclosed in the Barker patent provides an oil separator structure using offset flow tubes or channels contained within a relatively voluminous housing. The device disclosed in the Manolis patent provides an oil separator structure using aligned flow tubs in combination with baffles. The device disclosed in the Blanc patent provides an oil separator structure in the form of a filter cartridge.

SUMMARY OF THE INVENTION

The subject oil separation apparatus for use in an engine vent system is effective to conduct flow of air in opposite directions and prevents escape of any significant volumes of oil from the engine crankcase when air flow is outward therefrom. A tube within a tube design forms a compact and effective oil separation structure. The structure of the subject separator subjects the air flow to several directional and velocity changes effective to separate oil from air flow. An orifice in the bottom wall of an oil collecting reservoir controls the return flow of oil back into the interior of the engine.

DESCRIPTION OF EMBODIMENT SHOWN IN THE DRAWINGS

Figure 1:
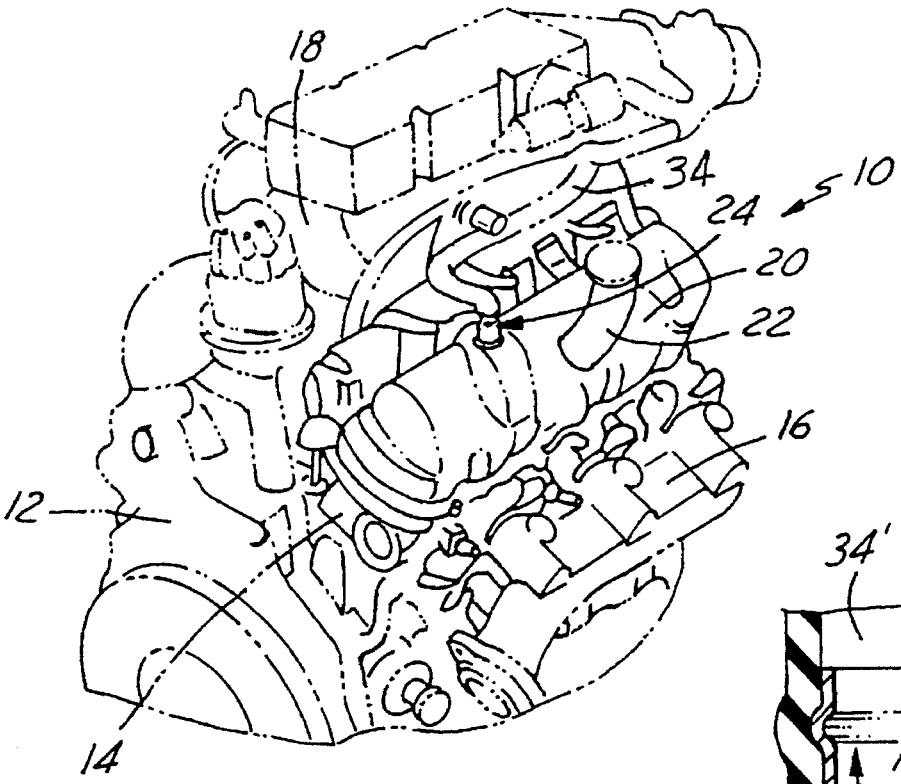
FIG. 1 is a perspective view of an engine with the subject device.

Turning now to FIG. 1, an internal combustion engine 10 is shown including an engine block portion 12 and a cylinder head portion 14. As is conventional, an exhaust manifold 16 is operatively attached to the cylinder head 14 to receive the combustion products from the engine. Likewise, an intake manifold 18 is operatively attached to the cylinder head to supply air to the engine.

A valve apparatus cover 20 is attached to the cylinder head 14 to define an interior space between it and the cylinder head 14. The interior space encloses conventional valve related components such as valve springs, rocker arms, etc. An oil inlet means in the form of a tube and cap 22 is attached to the cover 20 to permit addition of lubricating oil to the interior space. The interior space is connected by drain passages to the engine's crankcase (not shown). Passages in the cylinder head and the engine block (not shown) permit the oil to flow by gravity into the crankcase.

In an operating engine and the crankcase specifically, movements of the crankshaft, connecting rods and pistons in cylinders cause varying pressure conditions. Under some conditions, such as idle, negative pressures can be generated in the crankcase. Under other operating conditions, such as wide open throttle operation or operation under a significant load, positive pressures can be generated in the crankcase. Either of these conditions might cause undesirable actions particularly relative to the crankshaft seals unless these pressure conditions are accommodated.

The subject engine has a crankcase venting system to accommodate and modify the aforedescribed pressure conditions. Specifically, a two-way flow control device 24 is supported on valve cover 20. This control device communicates by a hose or conduit 34 the interior space defined by the valve cover and thus the crankcase with the engine air induction system including intake manifold 18.

Figure 3:
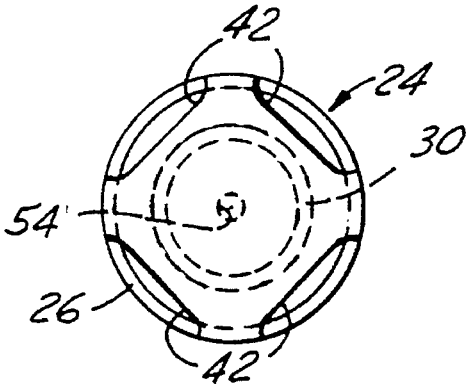
FIG. 3 is an end planar view looking toward the bottom surface of the subject oil separator.
Figure 2:
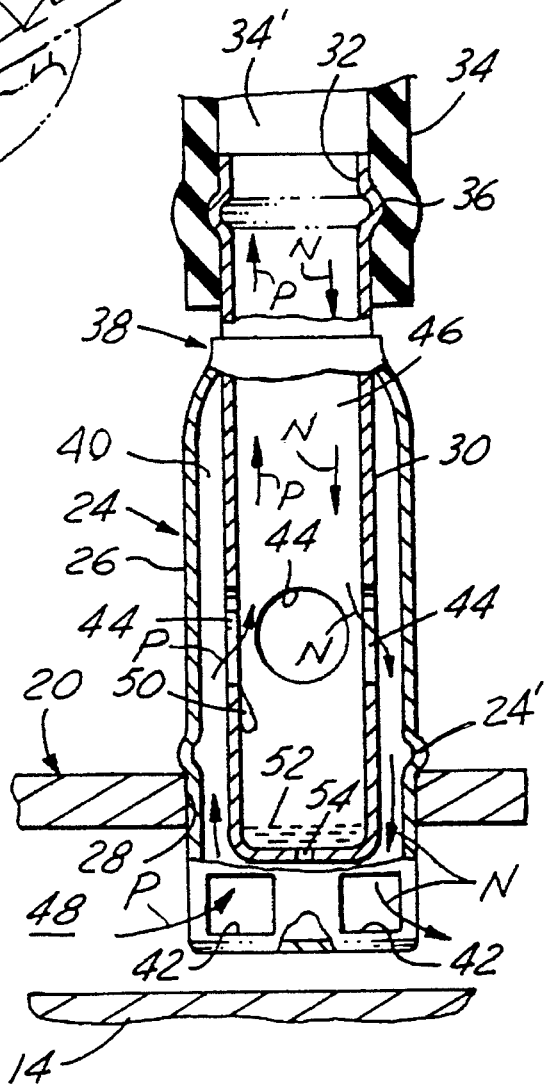
FIG. 2 is a side elevational and sectioned view of the subject oil separator showing alternate outward air flow from the engine interior and inward air flow to the engine interior.

Details of the control device 24 are more specifically shown in FIGS. 2 and 3. Control device 24 has a compact, thin-walled tube within a tube construction. An outer tube 26 has a lower end portion adapted to be inserted through an aperture 28 in the valve cover 20. An annular protrusion 24' is formed in the outer tube to limit insertion of the device into the valve cover 20. An inner tube 30 extends centrally through the tube 26 and has an upper end portion 32 adapted to be attached to the hose 34. Hose 34 defines an interior 34' which communicates with the engine induction system, including intake manifold 18. An annular bead or protrusion 36 is provided to help secure the hose to the device. As shown by the label 38, the upper end of the outer tube 26 is secured to the outer wall of the inner tube 30 by crimping or other suitable means. The attachment 38 of the tubes 26, 30 forms an annular flow passage 40 within control device 24. The annular passage 40 is connected by openings 42 to the interior space 48 between cylinder head 14 and valve cover 20. As seen in FIGS. 2, 3, the openings 42 are located at the lower end portion of the outer tube 26 and extend through the cylindrical side wall of tube 26. Located upwards from the openings 42 are apertures 44 formed in the inner tube 30. Apertures 44 communicate the annular passage 40 with the interior 46 of the inner tube and thus with the interior 34' of hose 34.

It can be seen that all flow of air between the engine crankcase and the engine induction system passes through the control device 24. During the engine operating conditions which tend to create negative pressure in the crankcase, a flow of air, labeled as N, cleaned by an air filter (not shown) of the engine induction system passes inward from the engine induction system to the crankcase. Specifically, the flow N passes from interior 34' of hose 34, through tube passage 46, apertures 44, passage 40, and openings 42. The air flow N then enters the interior 48 and passes into the engine crankcase to modify the aforedescribed negative pressure.

During engine operating conditions which tend to create positive pressure in the crankcase, a flow of air and oil mist, labeled as P, passes outward from the engine crankcase to the engine induction system. Specifically, flow P passes from interior 48 of valve cover 20, through openings 42, passage 40, apertures 44, tube passage 46, to interior 34' of hose 34. Unlike flow N, flow P is laden with an oil mist from the crankcase. It is undesirable for the oil mist to pass through to the induction system. A primary function of the control device 24 is to inhibit passage of oil.

The flow P must pass from the voluminous interior 48 through openings 42 and into the restricted annular passage 40. This causes a significant increase in flow velocity. Next, the flow P changes direction to pass through apertures 44 and then changes direction again to continue upward through passage 46. Immediately after passing through apertures 44, the flow enters the relatively large volume of tube passage 46. This significantly reduces the flow velocity. The change in flow direction and simultaneous reduction in flow velocity causes oil in mist form to separate from the air flow. The oil forms droplets 50 on the tube 30 which pass downward by gravity to a reservoir formed by the closed end of the tube 30. During such engine operation, the oil collects in the lower part of the tube as labeled 52 in FIG. 2. A small bleed passage or hole 54 permits a controlled return of the liquid oil back into the interior 48 and then to the crankcase.

While a preferred embodiment and methodology of the invention has been shown and described, other embodiments will now become apparent to those skilled in the art. Accordingly, this invention is not to be limited to that which is shown and described but by the following claims.

What is claimed:

1. To vent the crankcase of an internal combustion engine during operation thereof generating a positive pressure, a compact flow control device for separating oil from a mixture of air and oil flowing from the crankcase, comprising: an elongated first tubular member; an elongated second tubular member sized to permit it to be positioned coaxially within said first tubular member; an annular flow passage formed between said tubular members; means attaching and sealing said first tubular member's upper end portion to said second tubular member; at least one aperture extending through a midportion of said second tubular member to communicate said annular passage with the interior of said second tubular member; an upper end portion of said second tubular member extending upward from said attaching and sealing means to define an outlet from said control device; inlet openings formed in the lower end of said first tubular member to admit a mixed flow of air and oil from an engine crankcase into said device; said second tubular member having a substantially closed lower end to cause a flow of air and oil to pass upwardly through said annular passage, turn to pass through said apertures, and then turn to again flow upward through said second tubular member whereby changes in flow direction cause heavier oil to separate from the flow and drop to the lower portion of said second tubular member; means for collecting and returning such separated oil to the engine.

2. To vent the crankcase of an internal combustion engine during operation thereof tending to generate a positive pressure in the crankcase, a compact flow control device of tube within a tube configuration for separating oil from a mixture of air and oil flowing from the crankcase, comprising: an elongated first tubular member having an open upper end portion; an elongated second tubular member with a smaller diameter than said first tubular member; said second tubular member extending through said open end portion and coaxially into said first tubular member; an annular flow passage formed between said tubular members; means attaching and sealing said upper end portion of said first tubular member to said second tubular member; a plurality of apertures extending through a midportion of said second tubular member communicating said annular passage with the interior of said second tubular member; an upper end portion of said second tubular member extending upwardly from said attachment and sealing means to form an outlet for air from said crankcase under certain engine operating conditions; a plurality of openings formed in the lower end portion of said first tubular member for admitting a mixed flow of air and oil from the crankcase whereby the flow first passes upwardly through said annular passage, then abruptly changes direction to flow radially inwardly through said apertures, and then again changes direction to flow upwardly through said second tubular member to said outlet, whereby the abrupt directional changes cause separation of oil and air and the heavier oil to move to the lower portion of said second tubular member; means to control return of collected oil to the engine.

3. The separator device set forth in claim 2 in which the cross-sectional flow area of said annular passage is less than the cross-sectional flow area of said interior of said second tubular member thereby causing the velocity of flow to decrease as it is discharged from said apertures which further aids in separating heavier oil from air.

4. The separator device set forth in claim 2 in which said oil return means consists of a small hole in the lower portion of said second tubular member sufficient to return oil collected but insuffient to pass any appreciable quantity of air flow from said inlets.

* * * * *